US005587721A

United States Patent [19]

Koiwa

[11] Patent Number: 5,587,721

[45] Date of Patent: Dec. 24, 1996

[54] LIQUID CRYSTAL DRIVING APPARATUS

[75] Inventor: Atsushi Koiwa, Kawasaki, Japan

[73] Assignee: International Business Machines Corporation

[21] Appl. No.: 364,167

[22] Filed: Dec. 27, 1994

[30] Foreign Application Priority Data

Dec. 28, 1993 [JP] Japan ..... 5-337281

[51] Int. Cl.[6] ..... G09G 5/10

[52] U.S. Cl. ..... 345/89; 345/147

[58] Field of Search ..... 345/89, 87, 94, 345/147, 148, 149, 208; 348/254, 255, 256, 671, 673–682; 382/162–167, 169; 358/455–461

[56] References Cited

U.S. PATENT DOCUMENTS 4,427,978 1/1984 Williams ..... 345/147

5,041,823 8/1991 Johnson et al. ..... 345/94

*Primary Examiner*—Kee M. Tung
*Assistant Examiner*—Doon Chow
*Attorney, Agent, or Firm*—Ronald L. Drumheller

[57] ABSTRACT

In order to enable sharing between a TFT liquid crystal panel and an STN liquid crystal panel as well as provide a colorful gray scale representation, each signal electrode drive circuit for driving a liquid crystal includes a signal conversion means for converting a gray scale display voltage for TFT driving to a gray scale display pulse signal having a pulse width corresponding to the gray scale level. Accordingly, the apparatus for driving a liquid crystal panel such as a TFT liquid crystal panel in which the gray scale control is performed by using the voltage level can be used as the drive apparatus for a liquid crystal panel such as an STN liquid crystal panel in which the gray scale control is performed by pulse width modulation, and a multilevel gray scale representation is achieved because a gray scale display voltage is converted to a gray scale display pulse signal having a pulse width corresponding to the gray scale level.

1 Claim, 7 Drawing Sheets

LIQUID CRYSTAL DRIVING APPARATUS

BACKGROUND OF THE INVENTION

1. Field of the Invention

The present invention is related to an apparatus for driving a liquid crystal, and, more specifically, to an apparatus for driving a liquid crystal display having a matrix-driven color liquid crystal panel in which the liquid crystals forming the individual pixels of the panel are arranged in the form of a matrix.

2. Related Art

The display devices of personal computers and the like include small, lightweight liquid crystal panel displays (hereinafter, referred to as liquid crystal panels).

On the one hand, among the color liquid crystal panels of this type, the active matrix driven thin film transistor (TFT) liquid crystal panel is currently the most popular. In such a TFT liquid crystal panel, a twisted nematic (TN) liquid crystal is used in which the nematic liquid crystal is twisted by 90°.

On the other hand, the simple matrix type has not been used so much with the TN liquid crystal since the contrast decreases as the number of pixels to be displayed increases on a larger screen. However, a super twisted nematic (STN) liquid crystal has recently been developed in which the nematic liquid crystal is twisted by about 260 degrees. A color display has been constructed using an STN liquid panel.

As far as a single cell is concerned, the gray scale level is controlled by the voltage level in the TFT liquid crystal. Gray scale control by using pulse width modulation has been proposed for the STN liquid crystal.

However, since the gray scale level is controlled by the voltage level in the TFT liquid crystal and by pulse width modulation in the STN liquid crystal, as described above, sharing of a drive apparatus by both kinds of display panels has been difficult.

That is, there has been a problem in that, if an attempt is made to drive a TFT liquid crystal panel and an STN liquid crystal panel for display by using one common drive apparatus, the gray scale representation has been limited to a maximum of 8 colors (gray scale levels) with a cell construction using RGB and limited to a maximum of 16 colors (gray scale levels) with a cell construction using RGBI. For a further extended gray scale, the only way to increase the number of gray scale levels has been by frame rate modulation of dithering, so that the advantage inherent in the liquid crystal panels could not be exhibited.

Accordingly, at present, to provide a colorful gray scale representation, which is an advantage of liquid crystals, the drive apparatus for the TFT liquid crystal panel and the drive apparatus for the STN liquid crystal panel have been independently developed, which has resulted in an increase in the cost.

SUMMARY OF THE INVENTION

The present invention was accomplished in view of the above facts, and its object is to provide an apparatus for driving liquid crystals which can be shared by a TFT liquid crystal panel and an STN liquid crystal panel and which provides for a colorful gray scale representation.

The invention is an apparatus for driving a liquid crystal panel in which a gray scale display voltage is generated based on gray scale display data which indicates the gray scale level to be displayed to a liquid crystal cell, and the gray scale display voltage is applied to the liquid crystal cell to drive a liquid crystal, characterized by comprising a conversion means for converting the gray scale display voltage to a gray scale display pulse signal which has a pulse width corresponding to the gray scale level.

The inventive liquid crystal driving apparatus further comprises an output switching means for selecting and applying either the gray scale display voltage or the gray scale display pulse signal to the liquid crystal cell.

In accordance with the invention, a gray scale display voltage is converted by a signal conversion means to a gray scale display pulse signal which has a pulse width corresponding to the gray scale level. For this, an apparatus for originally driving a liquid crystal panel in which the gray scale control is carried out by using the voltage level, such as in a TFT liquid crystal panel, can be used as the drive apparatus for a liquid crystal panel in which the gray scale control is carried out by using pulse width modulation, such as in an STN liquid crystal panel, and a multilevel gray scale representation can be provided since the gray scale display voltage is converted to a gray scale display pulse signal which has a pulse width corresponding to the gray scale level.

In accordance with the invention, either the gray scale display voltage or the gray scale display pulse signal is selected by an output switching means and applied to a liquid crystal cell. Thus, if a switching signal for the selection is output by an appropriate control means according to the type of the liquid crystal panel to be used, the apparatus for driving a liquid crystal can be shared by a liquid crystal panel in which the gray scale control is carried out using the voltage level, such as a TFT liquid crystal panel, and a liquid crystal panel in which the gray scale control is carried out by using pulse width modulation, such as an STN liquid crystal panel. In addition, since either the gray scale display voltage or the gray scale display pulse signal (a gray scale display pulse signal which has a pulse width corresponding to the gray scale level) is selected, a multilevel gray scale representation can be provided.

BRIEF DESCRIPTION OF THE DRAWINGS

Now, an embodiment of the present invention will be described with reference to FIGS. 1 to 7 in which.

DESCRIPTION OF THE PREFERRED EMBODIMENT

Figure 1:
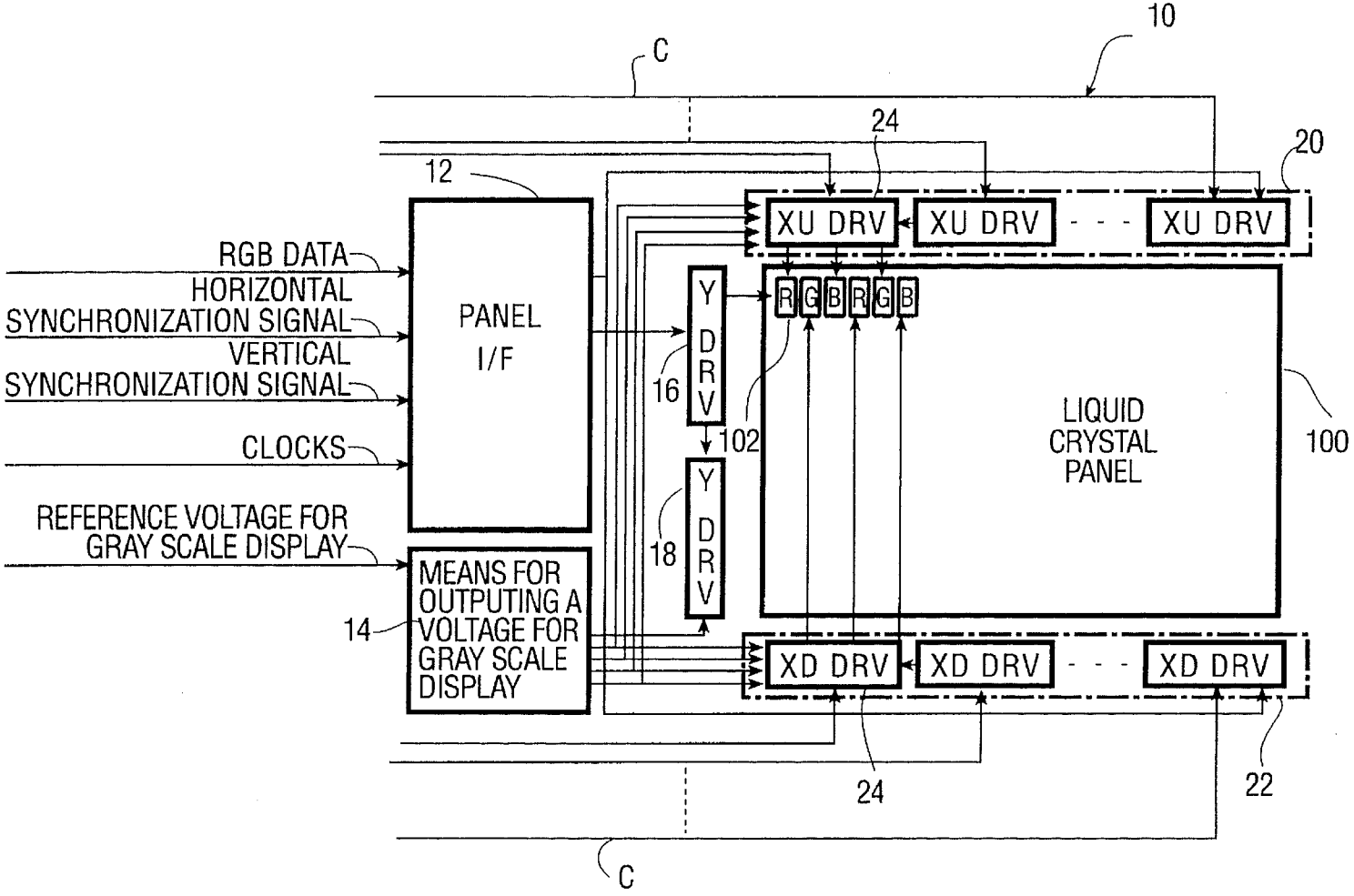
FIG. 1 is a block diagram schematically showing the construction of the apparatus for driving a liquid crystal in accordance with the present invention.

In FIG. 1, an apparatus for driving liquid crystal 10 related to the embodiment is schematically shown together with a liquid crystal panel 100 to be driven by the apparatus, for instance, as a panel of 640×480 dots.

The apparatus for driving liquid crystal 10 has a panel interface means 12, a means for outputting a voltage for gray scale display 14, an upper scanning electrode drive means 16, a lower scanning electrode drive means 18, a first signal electrode drive means 20, and a second signal electrode drive means 22.

Input to the panel interface means 12 are R, G, and B data (data for a subpixel), a horizontal synchronization signal, a vertical synchronization signal, and clock signals (CLOCKs) and the like, which are sent from a host apparatus (not shown).

The means for outputting a voltage for a gray scale display 14 is a circuit which outputs a gray scale display voltage V1, V2, . . . , Vn based on the reference voltage for the gray scale display.

The upper scanning electrode drive means 16 and the lower scanning electrode drive means 18 are circuits which respectively supply a drive voltage to the upper half and the lower half of the scanning electrode for the subpixels 102 corresponding to R, G, and B color filters which are, for instance, mosaicked on the liquid crystal panel 100, as shown in FIG. 1. The three liquid crystal cells 102 corresponding to R, G, and B are contained in one pixel.

The individual subpixel liquid crystal cells 102 corresponding to the mosaicked R, G, and B color filters are each connected to a predetermined signal electrode drive circuit 24. The first signal electrode drive means 20 drives the liquid crystal cells 102 on odd lines, and the second signal electrode drive means 22 drives the liquid crystal cells 102 on even lines.

A switching signal C is input to each of said signal electrode drive circuit 24 from a control circuit (not shown).

Figure 2:
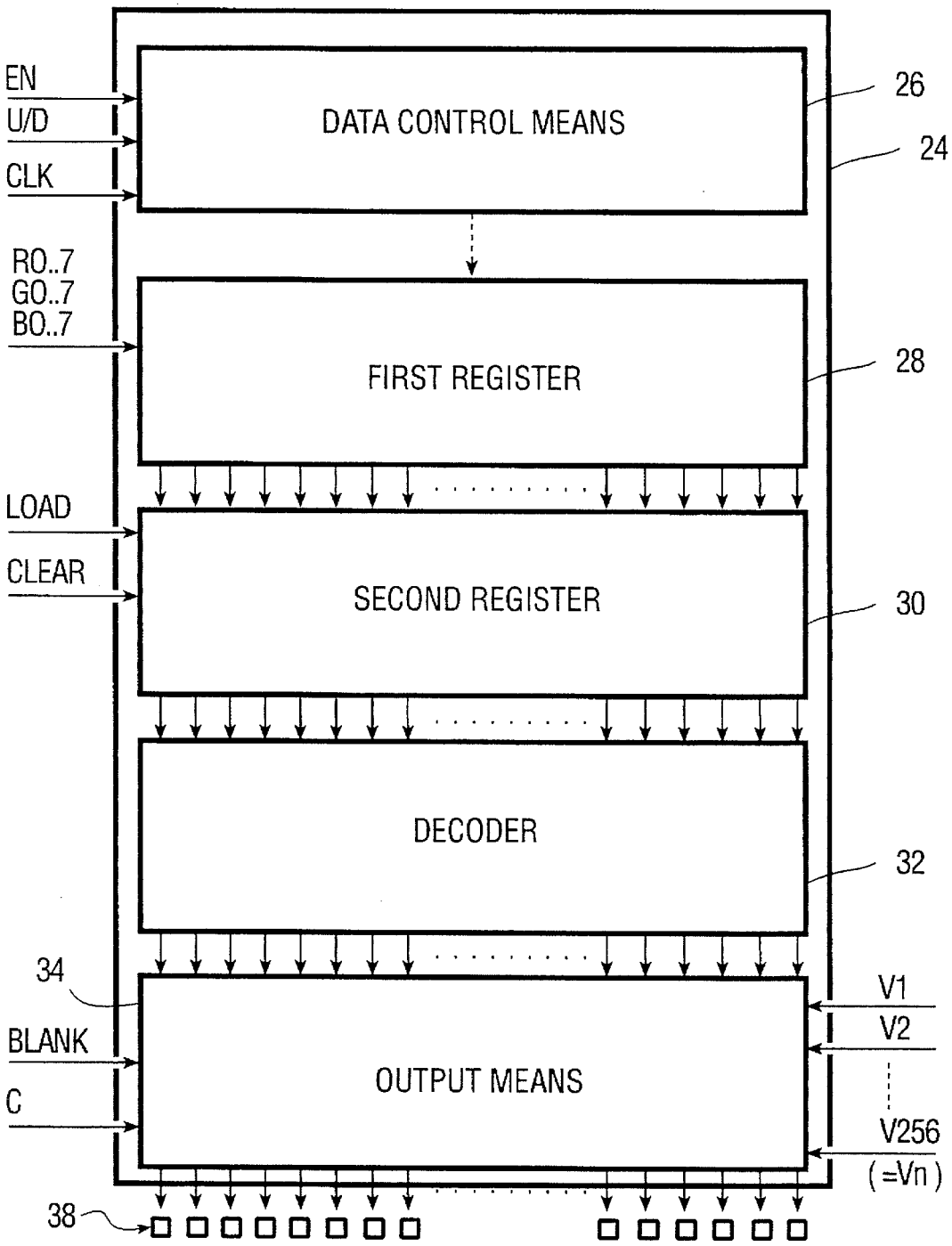
FIG. 2 is a block diagram showing the concrete construction of the signal electrode drive circuit in FIG. 1.

Each signal electrode drive circuit 24 is mounted on a film-like printed board for tape-automated bonding (TAB). The concrete construction of the signal electrode drive circuit 24 is schematically shown in FIG. 2. In FIG. 2, the signal electrode drive circuit 24 has a data control means 26 which outputs various control signals based on the inputs such as an enable (EN) signal, a U/D signal, and a dot clock (CLK) from the panel interface means 12; a first register 28 which temporarily holds the R, G, and B data of R0, R1, . . . , R7, G0, G1, . . . , G7 and B0, B1, . . . , B7 (see FIG. 6) from the panel interface means 12; a second register 30 which reads the R, G, and B data from the first register 28 by using LOAD as a read signal which rises in synchronization with the fall of a horizontal synchronization signal (see FIG. 6), and transfers the R, G, and B data just read to a decoder 32 in the next stage and temporarily holds them; the decoder 32 provided in the output stage of the second register 30; and an output means 34.

When a clear signal generated by the horizontal synchronization signal is input to the second register 30, it clears the R, G, and B data held by it.

The decoder 32 converts the R, G, and B data from the second register 30 to signals for driving the liquid crystal cells.

The output means 34 outputs any of the gray scale display voltages V1 to Vn (n=256 if 256 gray scale levels are displayed) from the means for outputting a voltage for the gray scale display 14 selected by the drive signal after conversion, and the output means 34 also outputs a gray scale display voltage acting as a TFT drive signal for a TFT liquid crystal panel and includes a switching circuit 36 as an output switching means (to be described later).

Figure 3:
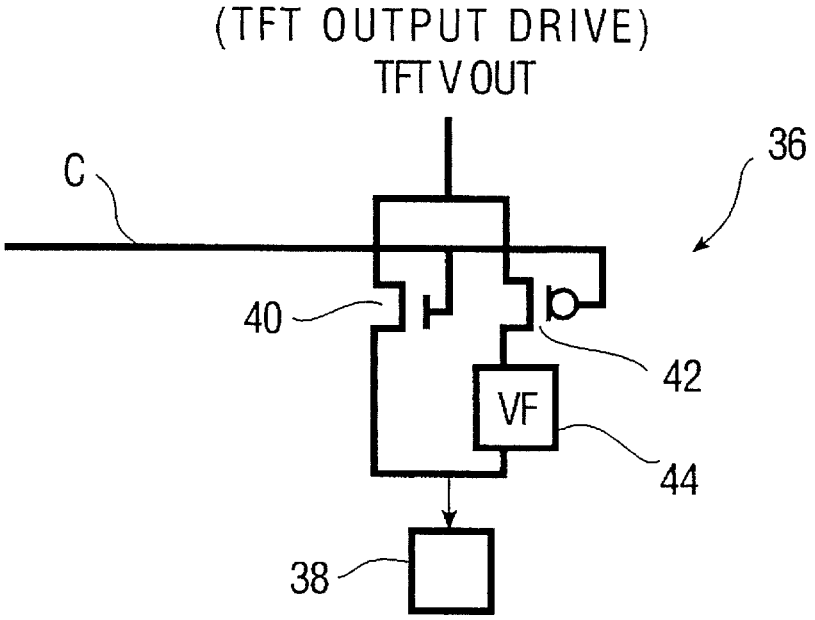
FIG. 3 is a circuit diagram showing an example of the construction of the switching circuit included in the outer means in FIG. 2.

An example of the construction of the switching circuit 36 is shown in FIG. 3. The switching circuit 36 is provided to correspond to the electrode 38 of the liquid crystal cell 102 on a one-to-one basis, and has a pair of analog switches, for instance, MOSFETs (hereinafter, abbreviated to FET) 40 and 42 which are connected in parallel between the output means 34 and the electrode 38.

The switching signal C from a control circuit (not shown) is directly applied to the gates of these FETs 40 and 42, or applied after being inverted, and a voltage-to-frequency conversion circuit (hereinafter, referred to as a "VF circuit") as a signal conversion means is connected to the source of the FET 42 to which the switching signal C is applied after being inverted.

Figure 4:
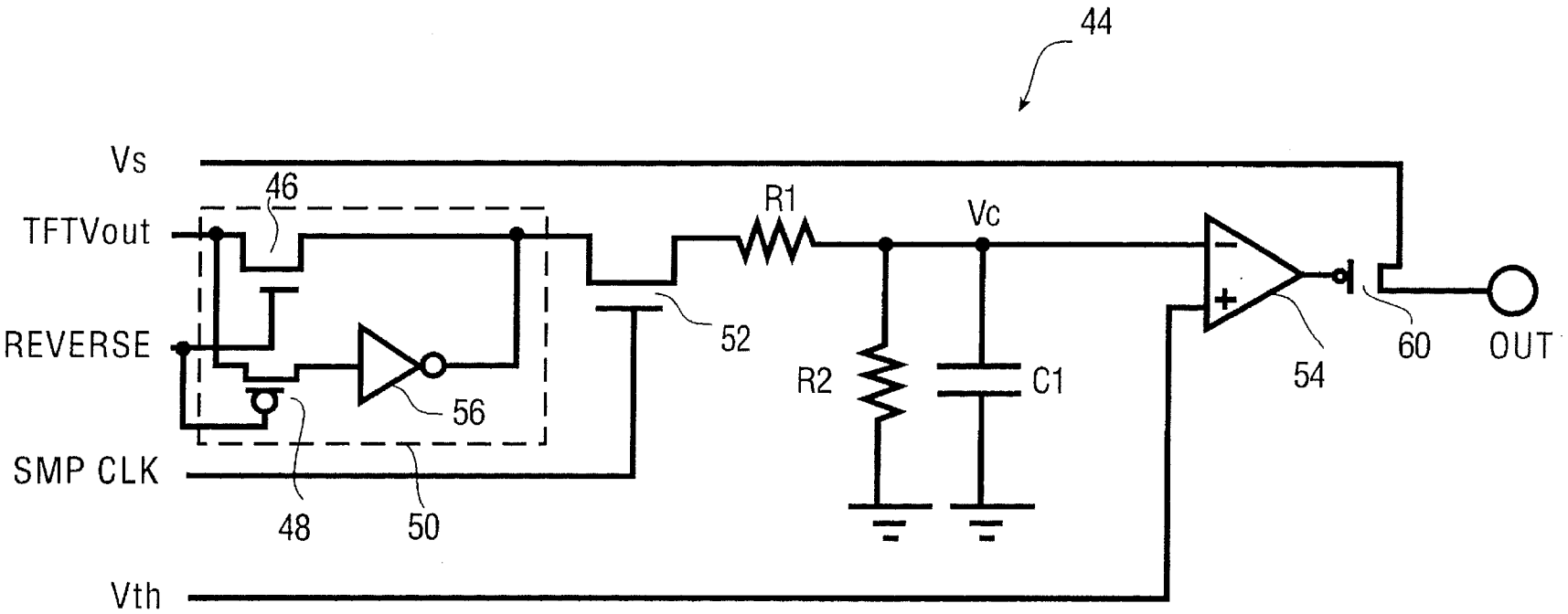
FIG. 4 is a circuit diagram showing an example of the construction of the VF circuit making up part of the swirling circuit in FIG. 3.

An example of the construction of the VF circuit is shown in FIG. 4. The VF circuit 44 has a first circuit 50 which always converts, to a positive voltage, the output for driving the TFT (TFTVout) which is inverted to positive or negative for each frame input through the FET 42 when the FET 42 is on, namely, a type of alternating current, an FET 52 whose drain is connected to the output of the first circuit 50 and whose source is connected to one end of a resistor R1, a comparator 54 whose inverted input is connected to the other end of the resistor R1, and a resistor R2 and a capacitor C1 connected in parallel between the other end of the resistor R1 and the ground.

More specifically, the first circuit 50 comprises a pair of FETs 46 and 48 having TFTVout input to the drains thereof. A reverse signal (REVERSE) is applied directly to the gates of these FETs 46 and 48 or after being inverted. The input terminal of an inverter circuit 56 is connected to the source of the FET 48 to which the reverse signal is applied after being inverted, and the output of the inverter circuit 56 is connected to the source of the FET 46 to construct the output terminal of the first circuit 50. The reverse signal is a signal for alternately switching the FETs 46 and 48 according to whether TFTVout is positive or negative. That is, when TFTVout is positive, the FET 46 is turned on if the reverse signal is positive, allowing TFTVout to be directly output from the first circuit 50, and, when TFTVout is negative, the FET 48 is turned on if the reverse signal is negative, allowing TFTVout to be output after being inverted from the first circuit 50.

A sampling clock (SMP CLK) is applied to the gate of the FET 52 at predetermined timing intervals.

A predetermined reference voltage Vth is applied to the noninverting input terminal of the comparator 54. Further, the output of the comparator 54 is applied to the gate of a FET 60 through an inverter element, and a predetermined voltage Vs (a fixed value) is applied to the drain of the FET 60. For this, the FET 60 is turned on only when the comparator 54 is off to output the predetermined voltage Vs and the output (OUT) of the FET 60 is applied to the electrode 38 of the liquid crystal cell 102 as a voltage for driving the STN liquid crystal panel.

Figure 5:
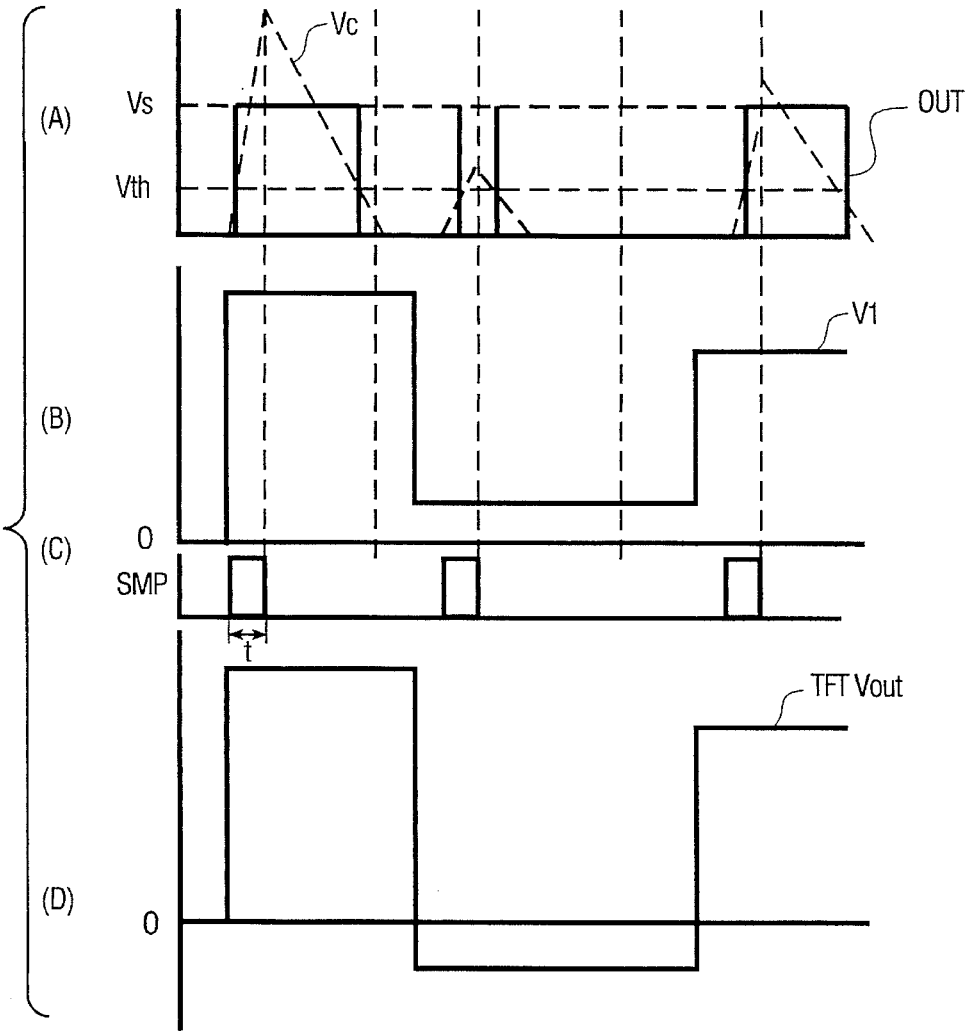
FIG. 5 is a timing chart for explaining the action of the VF circuit in FIG. 4.

The operation of the VF circuit 44 will now be described with reference to the timing chart in FIG. 5.

A voltage TFTVout as shown in FIG. 5(D) is input from the output means 34 to the first circuit 50 and processed as described above, and a voltage V1 as shown in FIG. 5(B) is output from the first circuit 50.

With this voltage V1, the FET 52 is turned on while the sampling clock (SMP CLK) is high, the capacitor C1 is charged, and a potential Vc (see FIG. 4) gradually increases as shown by the dotted line in FIG. 5(A). When the sampling clock goes low, the FET 52 turns off, the capacitor C1 discharges through the resistor R2, and the potential Vc gradually decreases. Thus, depending on whether the sampling clock is high or low and the change in the level of the voltage V1, the potential Vc changes as shown by the dotted line in FIG. 5(A). The potential Vc is compared with the predetermined reference voltage Vth by the comparator 54, and as long as Vc>Vth is valid, the FET 60 is on and the output (OUT) of the VF circuit 44 becomes high. Thus, eventually, a voltage pulse whose pulse width corresponds to the absolute value of TFTVout is output from the VF circuit 44, as shown by the solid line in FIG. 5(A). Accordingly, using this VF circuit 44, TFTVout for the gray scale control of the TFT liquid crystal panel from a TFT drive (not shown) can be converted to a pulse for the gray scale control of the STN liquid crystal panel.

In addition, for a time t during which the sampling clock is high, the above described potential Vc becomes $$V_p(t) = \frac{R_2 V_1}{R_1 + R_2}\left[1 - \exp\left(-\frac{R_1 + R_2}{C_1 R_1 R_2}\, t\right)\right]$$

or for a time during which the sampling clock is low, it becomes $$V_p(t) = V_p(0)\exp\left(-\frac{1}{C_1 R_2}\, t\right)$$

For instance, the combinations of ($C_1$, $R_1$, $R_2$) for terminating the charging in 1 μs and discharging in 10 ms include (1 μF, 0.4 Ω, 1 kΩ), (1000 pF, 400 Ω, 1 MΩ) and the like. These are examples of shifting to the left (shifting the peak of Vc to the left). As examples of shifting to the center (shifting the peak of Vc to the center), there are combinations such as (2 μF, 16 kΩ, 1 kΩ), assuming that charging is terminated in 5 ms and discharging in 5 ms.

The action of the above described switching circuit 36 is explained below.

On the one hand, if a switching signal C with a high level (in this case, for the TFT liquid crystal panel) is input from a control device (not shown), the FET 40 is turned on, and, in the switching circuit 36, the output for TFT driving (TFTVout) is directly applied to the electrode 38. On the other hand, if a switching signal C with a low level (in this case, for the STN liquid crystal panel) is input from the control device (not shown), the FET 42 is turned on, and, in the switching circuit 36, the output for TFT driving (TFTVout) is converted by the VF circuit 44 to a pulse for driving the STN liquid crystal panel, whose pulse width corresponds to the voltage value (corresponding to the gray scale level), as described above, and whose pulse is applied to the electrode 38.

Consequently, in accordance with the apparatus for driving liquid crystal 10 of this embodiment, if a TFT liquid crystal panel is connected and a switching signal C with high level is applied from a control device (not shown), the connected TFT liquid crystal panel can be driven in a manner similar to the publicly known apparatus for driving a TFT liquid crystal panel, thereby to perform a multilevel gray scale control, and if a STN liquid crystal panel is connected and a switching signal C with a low level is applied from the control device (not shown), the voltage signal TFTVout output, which is originally output from the output means 34 for driving a TFT liquid crystal panel and has a level depending on the gray scale level, is converted to a pulse having a pulse width corresponding to the gray scale to drive a STN liquid crystal panel, thereby enabling a multilevel gray scale control.

Practically speaking, in the apparatus for driving liquid crystal 10, if the liquid crystal panel 100 is a TFT liquid crystal panel, for instance, the TFTs for one line constituting the liquid crystal panel 100 are turned on at the same time by the upper scanning electrode drive means 16 and TFTVout for one line is applied to each liquid crystal cell through the TFTs by the inputting of a LOAD signal, and then TFTVout for one line is applied through the TFTs to each liquid crystal cell of the second line constituting the liquid crystal panel 100. In this way, the display and gray scale control of liquid crystal cells is performed for each line. In addition, if the liquid crystal panel 100 is a STN liquid crystal panel, for instance, the driving of scanning electrodes by the upper scanning electrode drive means 16 and the driving of signal electrodes by the first and second signal electrode drive means 20 and 22 are performed at the same time, and the pulse converted from TFTVout is applied to the respective liquid crystal cells for one line at the intersections of these electrodes to perform display and gray scale control.

Figure 6:
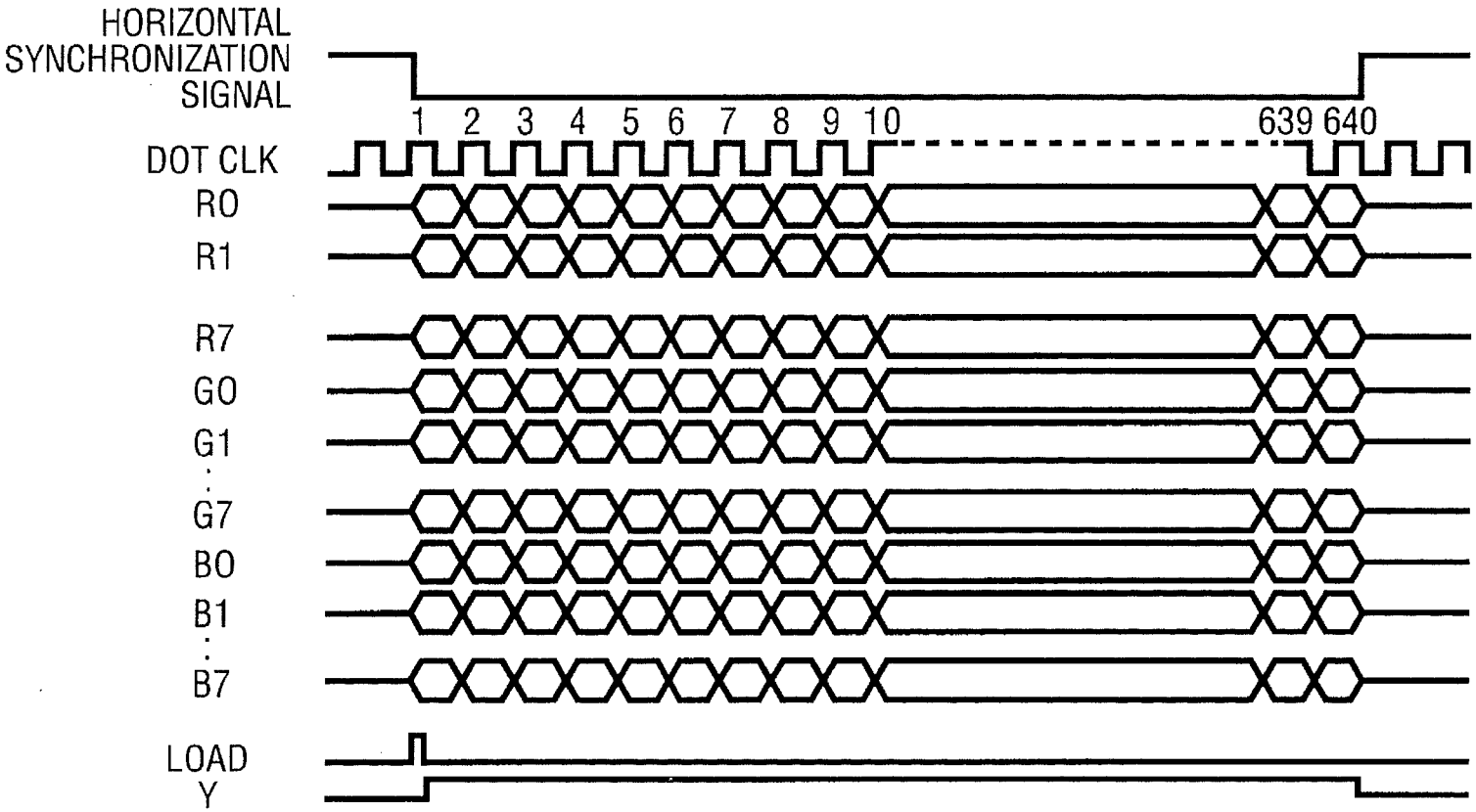
FIG. 6 is a diagram showing the data and control signals for one line according to the apparatus for driving a liquid crystal correspondingly to a dot clock (DotCLK)
Figure 7:
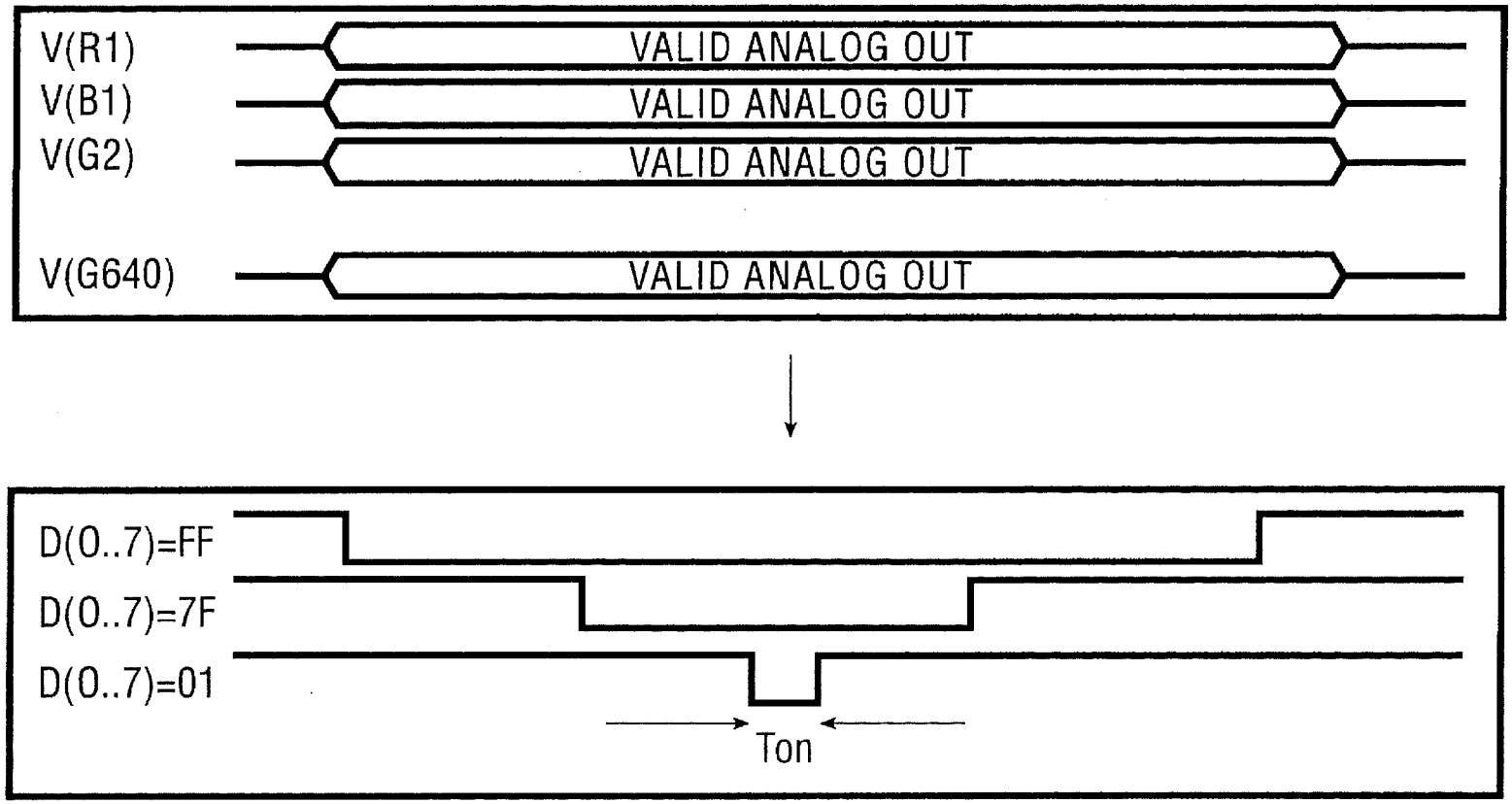
FIG. 7 is a block diagram conceptually showing the conversion to voltage pulse signals for the gray scale control of the liquid crystal cells of the subpixels corresponding to 640 pixels for one line by the apparatus of driving a liquid crystal.

The data and control signals for one line for the apparatus for driving liquid crystal 10 is shown in FIG. 6 so as to correspond to a dot clock (DotCLK). Further, FIG. 7 shows conceptually how the voltages (256 gray scale levels) for the gray scale control of the liquid crystal cells of the subpixels corresponding to 640 pixels (for one line) are converted by the apparatus for driving liquid crystal 10 of this embodiment to pulse signals of 256 gray scale levels having different pulse widths.

In addition, so-called frame rate control or dithering may be performed simultaneously with the conversion of TFTVout to a pulse described in the above embodiment, which makes the gray scale control easier.

Further, although, in the above embodiment, the switching signal C is output from a control device (not shown) by way of example, a construction may be used in which the switching signal C is input to the apparatus for driving liquid crystal 10 by operating a manual switch in response to the type of panel connected.

As described above, in accordance with the apparatus for driving liquid crystal related to the present invention, there is an excellent advantage in that it can be shared between a TFT liquid crystal panel and an STN liquid crystal panel and enables a colorful gray scale representation which has not been provided up to the present.

I claim:

1. Apparatus for driving a gray scale liquid crystal display panel from gray scale display data representing the gray scale level to be displayed by each liquid crystal cell of the liquid crystal display panel, irrespective of whether said gray scale liquid crystal display panel requires gray scale input in the form of a variable voltage amplitude signal or in the form of a variable pulse width signal, said apparatus comprising:

means for generating a gray scale display voltage corresponding to said each liquid crystal cell, said gray scale display voltage having an amplitude corresponding to the gray scale display data for said each liquid crystal cell;

a signal conversion means for converting said gray scale display voltage to a gray scale display pulse corresponding to said each liquid crystal cell, said gray scale display pulse having a pulse width corresponding to the amplitude of the gray scale display voltage for said each liquid crystal cell; and a switching means for selecting and applying to said each liquid crystal cell either said gray scale display voltage or said gray scale display pulse depending upon whether said gray scale liquid crystal panel requires gray scale input in the form of a variable voltage amplitude signal or in the form of a variable pulse width signal respectively.

* * * * *